US007178443B2

(12) United States Patent
Isgen et al.

(10) Patent No.: US 7,178,443 B2
(45) Date of Patent: Feb. 20, 2007

(54) WEDGE-TYPE BREECHBLOCK

(75) Inventors: Helmut Isgen, Willich (DE); Henning von Seidlitz, Neuss (DE)

(73) Assignee: Rheinmetall W. & M GmbH, Unterluss (DE)

( * ) Notice: Subject to any disclaimer, the term of this patent is extended or adjusted under 35 U.S.C. 154(b) by 250 days.

(21) Appl. No.: 10/824,620

(22) Filed: Apr. 15, 2004

(65) Prior Publication Data

US 2004/0226435 A1 Nov. 18, 2004

(30) Foreign Application Priority Data

Apr. 15, 2003 (DE) ..... 103 17 177

(51) Int. Cl.
*F41A 5/00* (2006.01)

(52) U.S. Cl. ..... 89/4.2; 89/4.05; 89/156; 89/22

(58) Field of Classification Search ..... 89/4.2, 89/4.05, 22, 24, 33.03, 156
See application file for complete search history.

(56) References Cited

U.S. PATENT DOCUMENTS 798,882 A * 9/1905 Dearborn ..... 89/4.05
1,003,288 A * 9/1911 Muller ..... 89/4.2
1,387,460 A 8/1921 Beets
2,365,459 A 12/1944 Dobremysl
3,866,513 A 2/1975 Hornfeck et al.
4,357,857 A * 11/1982 Magnuson ..... 89/156
4,791,851 A * 12/1988 Stoner ..... 89/156
5,659,992 A 8/1997 Mistretta

* cited by examiner

*Primary Examiner*—Michelle Clement
(74) *Attorney, Agent, or Firm*—Venable LLP; Stuart I. Smith

(57) ABSTRACT

A wedge-type breechblock is provided for a weapon having a barrel that recoils relative to a cradle, the barrel having a bore with an axis, and a breech plate. The breechblock includes a closing wedge for arranging in the breech plate such that the closing wedge can be displaced transverse to the axis of the bore. A pin-type carrier, through a control lever and a breech mechanism shaft, activates the closing wedge. An ascending curved track is located on a guiding device, and guides the pin-type carrier during a counter-recoil motion of the barrel from an intake region to a highest point, so that the control lever is pivoted during the counter-recoil motion of the barrel and the breech mechanism shaft is turned to move the closing wedge to an opened position.

9 Claims, 4 Drawing Sheets

12
13
14
16
17
18
19
20
22
22
23
24
25
26
27
28

WEDGE-TYPE BREECHBLOCK

CROSS REFERENCE TO RELATED APPLICATION

This application claims the priority of German Patent Application, DE 103 17 177.0 filed Apr. 15, 2003, which is incorporated herein by reference.

BACKGROUND OF THE INVENTION

The invention relates to a wedge-type breechblock for a weapon, comprising a weapon barrel that recoils relative to a cradle, as well as a breech plate in which a closing wedge is arranged that can be displaced transverse to the barrel axis of bore and can be operated with the aid of a breech-mechanism shaft.

It is known that with large-caliber weapons having transverse moving breechblocks, the respective closing wedge can be opened automatically during the counter-recoil motion of the weapon barrel with the aid of a breech-mechanism shaft. The breech-mechanism shaft is mounted perpendicular to the barrel axis of the bore and connected to an external drive that is mounted rigidly on the cradle, e.g. for removing the cartridge case following a firing and for inserting a new cartridge into the weapon chamber. The disadvantage of transverse moving breech mechanisms of this type is, among other things, that an external drive and a relatively involved opening mechanism are required.

A transverse moving breechblock designed as a breech door is already known from German reference DE-PS 1 578 049, wherein this mechanism is opened automatically with the aid of two roller carriers. During the counter recoil motion of the weapon barrel, these carriers respectively roll in an upward direction along an upwardly curved track of a guide that is rigidly mounted on the cradle and, in the process, lift up the breechblock. Following the loading, the disengaged breechblock again drops down and closes off the weapon barrel. For the recoil motion, the weapon barrel is guided in a straight line inside a guide groove which transitions into the curved path, such that the ascending curved path in the region of the guide grooves is designed as a diverter that can pivot out in an upward direction. A separate drive is not required for weapons having a breech-block of this type.

SUMMARY OF THE INVENTION

It is an object of the present invention to provide a wedge-type breechblock with simple design, which permits the automatic opening of the breechblock during a high firing sequence without requiring an additional external drive.

Particular embodiments of the invention provide a wedge-type breechblock for a weapon having a barrel that recoils relative to a cradle, the barrel having a bore with an axis, and a breech plate. The breechblock includes a closing wedge for arranging in the breech plate such that the closing wedge can be displaced transverse to the axis of the bore; at least one control lever; a pin-type carrier attached to the control lever; a breech mechanism shaft that activates the closing wedge, the breech mechanism shaft being connected on a side that faces the cradle to the control lever; at least one guiding device for guiding the pin-type carrier is provided on the cradle on a side of the cradle that faces the barrel; an ascending curved track located on the guiding device, along which the pin-type carrier is guided during a counter-recoil motion of the barrel from an intake region to a highest point, so that the control lever is pivoted during the counter-recoil motion of the barrel, and the breech mechanism shaft is turned to move the closing wedge to an opened position; and a straight guide track located on the guiding device, positioned lower than the highest point of the curved track, and which transitions to the intake region of the ascending curved track. At least the curved track of the guiding device that follows the intake region is designed to function as a diverter for the carrier during the counter-recoil motion of the barrel.

Embodiments of the invention are based on the idea of providing a curved track on a guiding device that is rigidly mounted on a cradle for guiding a pin-type carrier. The carrier does not directly cause the lowering and lifting up of the closing wedge, but causes the breech mechanism shaft to run, which in turn acts upon the closing wedge, for example via a toothed gear or a lever gear.

The guiding device for guiding the carrier during the recoil motion of the weapon barrel is provided with a straight guide track, positioned lower than the highest point of the curved track. The straight guide track transitions to the intake region for the ascending curved track, wherein at least the region following the intake region of the ascending curved track of the guiding device is designed as a deflector for the returning pin-type carrier.

Constructing the curved track with at least two adjoining sections has proven to be especially advantageous, wherein the first section of the curved track is arranged on a first part of the guiding device that directly adjoins the intake region, and is designed to pivot counter to the pressure of a spring around an axis arranged perpendicular to the longitudinal axis of the pin-type carrier. During the recoil motion of the weapon barrel, the pin-type carrier pivots the first part away from the weapon barrel toward the side and thus reaches the intake region.

A guiding device of this type among other things has the advantage that during the recoil motion of the weapon barrel only the first section with low weight is turned by the pin-type carrier, so that it can be accelerated for a quick firing sequence to reach values of >15 m/s.

As a result of the sectional design of the curved track, it is also not necessary to replace the complete guiding device in case of wear on the curved track, which preferably consists of a hardened material, but only the section that is worn.

Providing the curved track with an approximately sine-shaped form has furthermore proven advantageous as well. As a result, a non-jerking, impact-free sliding movement of the pin-type carrier is ensured during the opening lift.

With a different embodiment according to the invention, the pin-type carrier is not only supported on the curved track, but is also guided by a fixed curve arranged above the curved track, so that the carrier is guided along an ascending, groove-shaped recess. The upper curve prevents the breech closing mechanism from being ejected outward during high counter-recoil speeds of the weapon barrel (e.g. 2.5 m/s).

It has proven advantageous if the length of the first curved track section amounts to at least 60% of the length of the total curved track.

To be able to replace the guiding device or parts thereof quickly in case of need, a base plate is provided according to one embodiment of the invention, on which the second part carrying the second section of the curved track is rigidly mounted and the first part carrying the first section of the curved track is mounted so as to pivot.

When using the wedge-type breechblock according to the invention, it has furthermore turned out that the dynamic stresses are considerably lower than for comparable wedge-type breechblocks having a breech mechanism for automatically opening the closing wedge. The base plate as well as the first and second part of the guiding device can thus be produced cheaply with, for example, the cast-iron production method.

BRIEF DESCRIPTION OF THE DRAWINGS

Further advantages and details of the invention follow from the exemplary embodiments and are explained in the following with the aid of the Figures, in which.

DETAILED DESCRIPTION OF THE INVENTION

Figure 1:
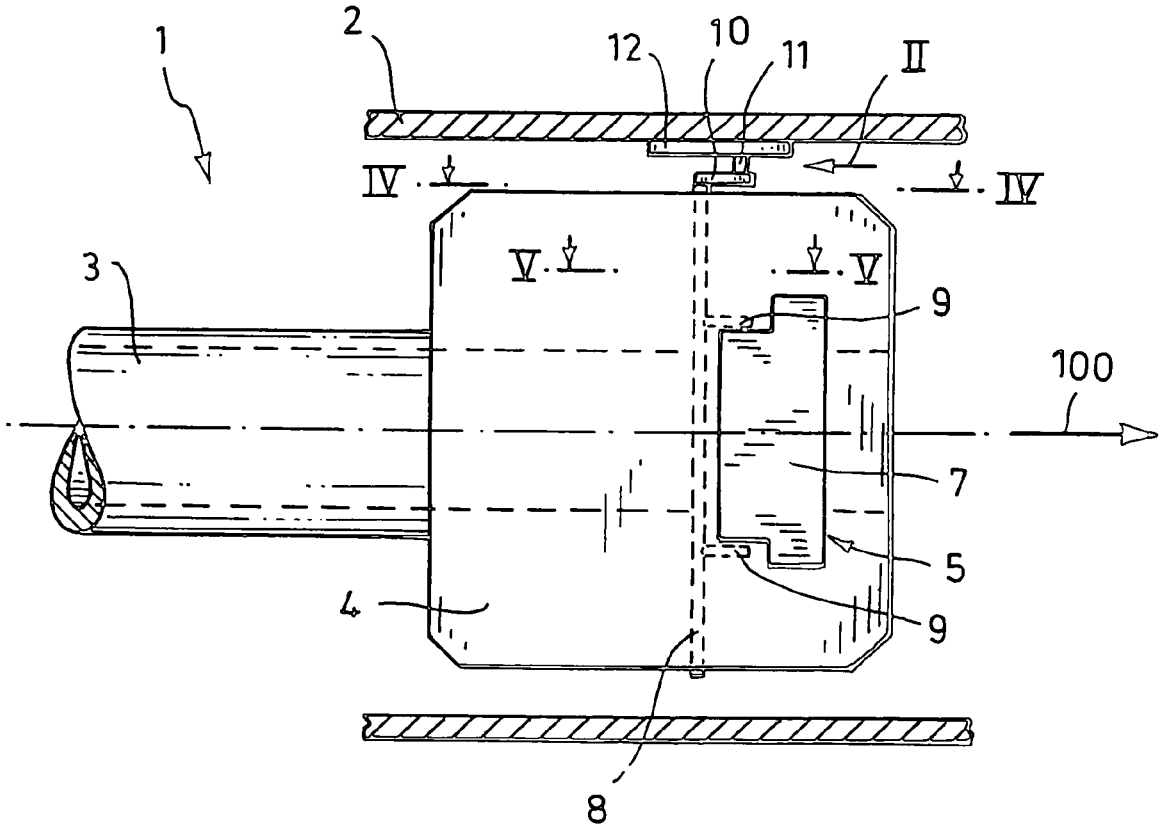
FIG. 1 shows a plan view of the breech mechanism region of a large-caliber weapon barrel positioned inside a cradle.

FIG. 1 shows a weapon 1 with a weapon barrel 3 that recoils relative to a cradle 2. The rear part of the weapon barrel 3 is connected to a breech plate 4, which accommodates a transverse moving breechblock 5.

The transverse moving breechblock 5 comprises a closing wedge 7 that is displaceable transverse to the barrel axis of the bore, as well as a breech mechanism shaft 8, shown with dashed lines, which is connected to breech-mechanism levers 9 that act upon the closing wedge 7 from opposite sides. On its right side and facing the cradle 2, the breech-mechanism shaft 8 is additionally connected a control lever 10, to which a pin-type carrier 11 is attached. This carrier 11 engages in a guiding device 12 that is mounted on the cradle 2.

Figure 2:
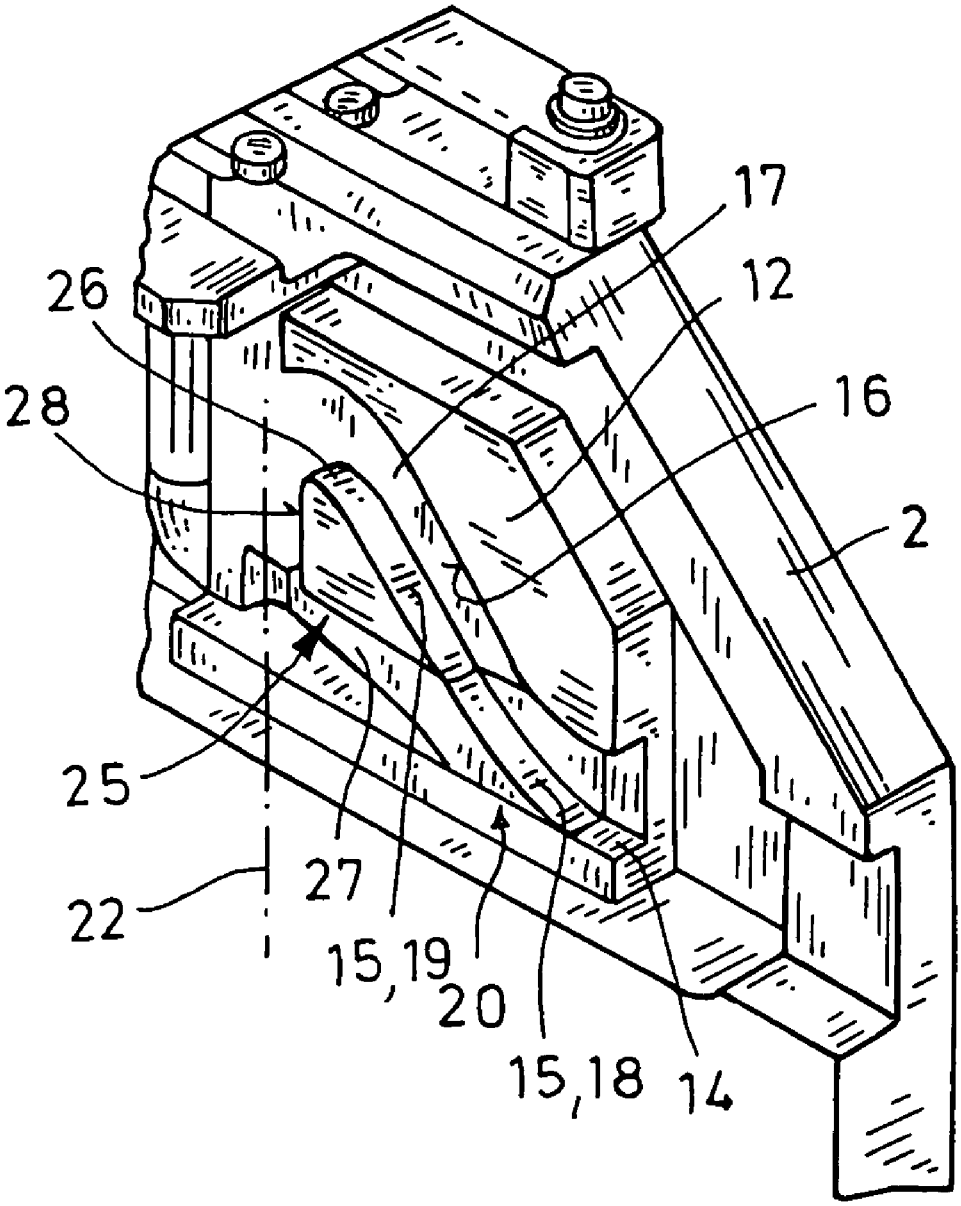
FIG. 2 shows a schematic perspective view of the cradle region, given the reference II in FIG. 1, with examples of guiding devices in accordance with the invention arranged thereon.

The guiding device 12 comprises a cast-iron base plate 13 (FIG. 3) which is screwed, for example, to the cradle 2. A curved track 15 (FIG. 2) is arranged on this base plate for guiding the carrier 11 during the counter recoil motion of the weapon barrel 3, which track curves upwards in an approximately sine-shaped form from an intake region 14 to a highest point 26.

An upper side wall 16 is provided at a specified distance to the curved track 15, which follows the same course as the curved track 15, so that the carrier 11 is guided inside a groove-shaped recess 17.

Figure 3:
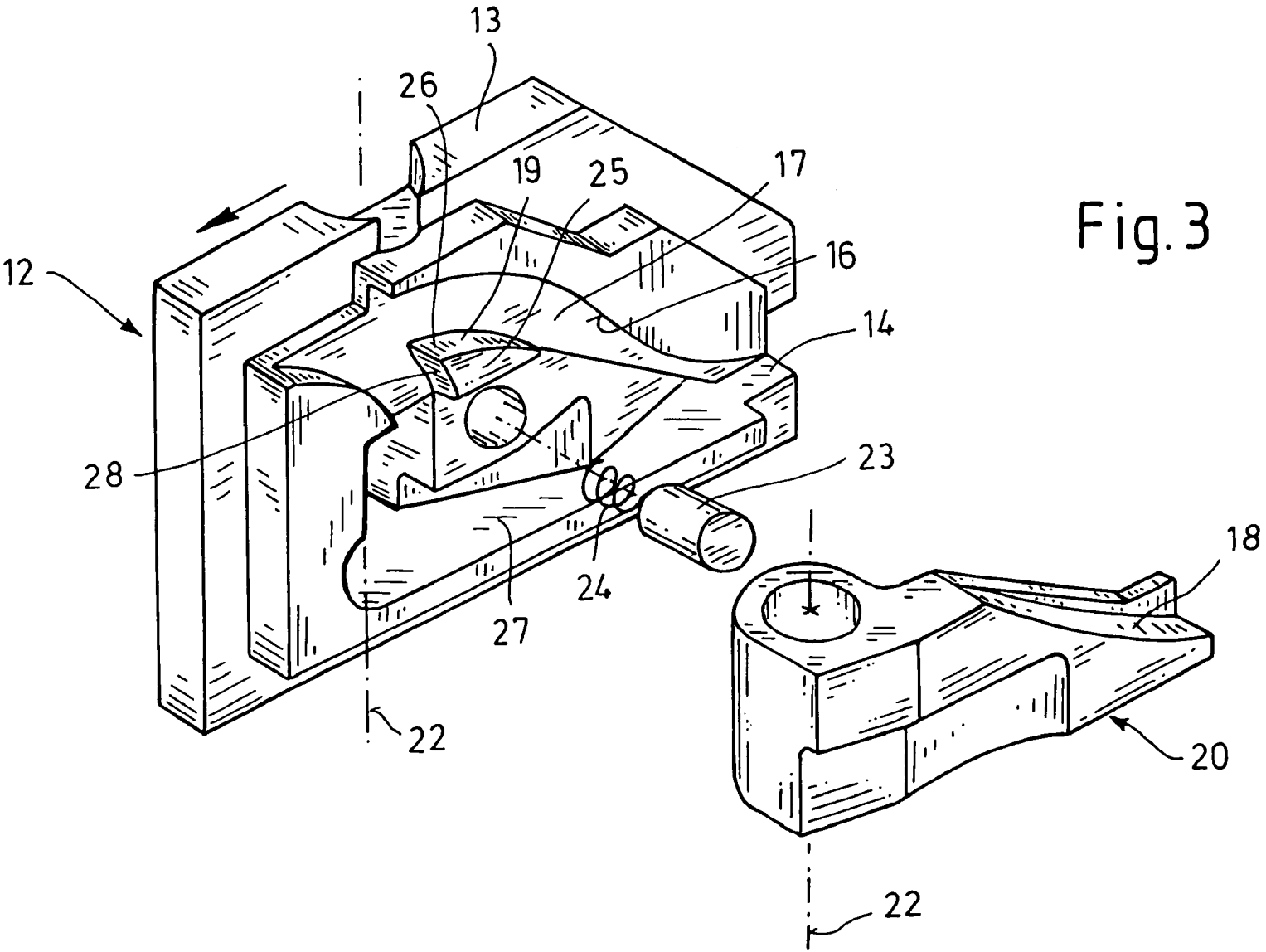
FIG. 3 shows an enlarged, exploded perspective view of the guiding device shown in FIG. 2.

The curved track 15 consists of two adjoining sections 18, 19, wherein the first section 18 of the curved track 15 is formed by a first part 20, immediately adjoining the intake region 14 of the guiding device 12. This first part 20 is also made from cast iron (e.g. 14NiCr18 high quality steel casting) and is arranged on the base plate 13 of the guiding device 12, such that it can be pivoted around an axis 22 that is positioned perpendicular to the longitudinal axis of the pin-type carrier 11. In the resting position, shown in FIG. 2, this part is held in place with the aid of a pushrod 23 (FIG. 3). A spring 24 which is supported on the base plate 13 acts upon the pushrod 23.

A second part 25 that is fixedly connected to the base plate 13 and is also made from cast iron forms the second section 19 of the curved track 15.

In addition, the guiding device 12 also has a straight guide section 27, for guiding the carrier 11 during the recoil motion of the weapon barrel 3, positioned lower than the highest point 26 of the curved track 15 and which transitions into the intake region 14 of the curved track 15.

In the following, we want to discuss in further detail the mode of operation of the wedge-type breechblock 5 according to the invention. For this, we assume that the weapon barrel 3 contains a projectile and a propellant charge (e.g. a cartridge charge) and that the closing wedge 7 is in the closed position.

If the propellant charge is ignited and the projectile is fired, the firing causes a recoil motion which displaces the weapon barrel 3 along with the breech plate 4 rearward (indicated with arrow 100 in FIG. 1). In the process, the pin-type carrier 11 also slides rearward along the guide track 27, and pivots the first part 20 (provided with the first section 18 of the curved track 15) toward the side and into a corresponding recess in the cradle 2, so that the carrier 11 reaches the intake region 14 of curved track 15.

Figure 4:
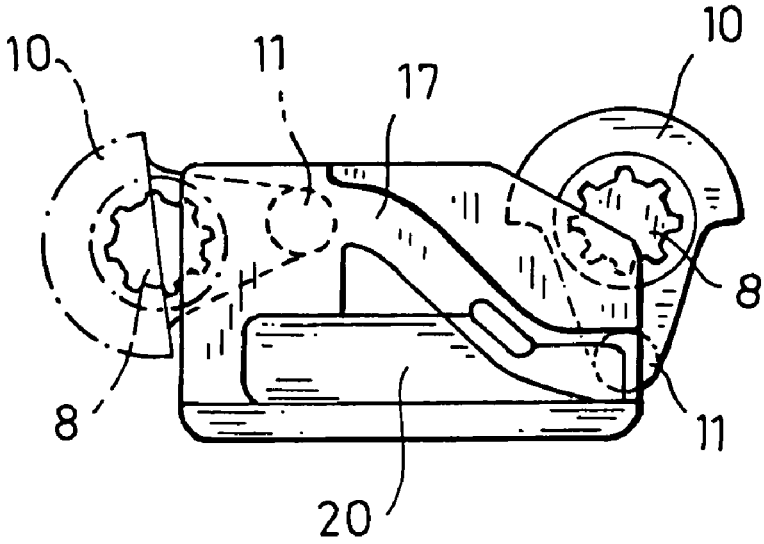
FIG. 4 shows an enlarged view from the side of the breech mechanism region of the weapon barrel, as seen along sectional line IV—IV in FIG. 1.
Figure 5:
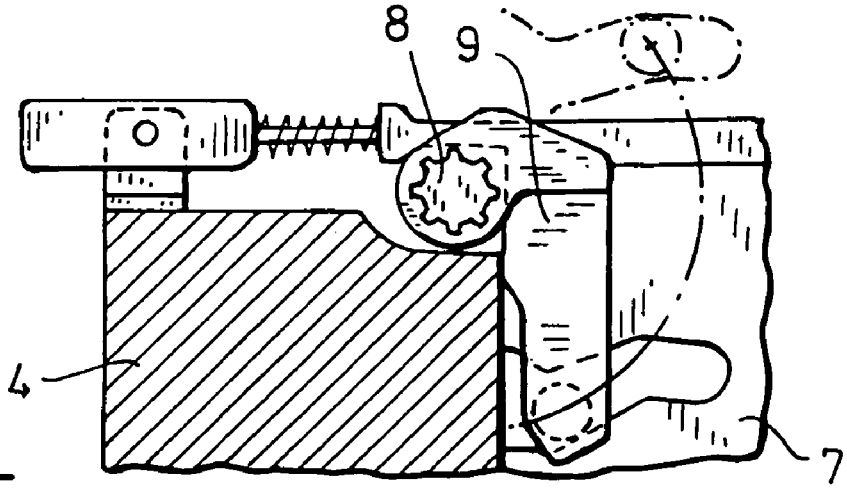
FIG. 5 shows an enlarged view of the breech mechanism region of the weapon barrel, as seen along sectional line V—V in FIG. 1.

Once the weapon barrel 3 has been displaced to the maximum rearward position, it is pushed in the forward direction without interruption by a barrel counter-recoil mechanism (not shown herein). During the counter-recoil motion of the weapon barrel 3 and the breech plate 4, the pin-type carrier 11 moves along the ascending curved track 15 (FIG. 2) and, as a result of pivoting the control lever 10 and turning the breech mechanism shaft 8, causes the breech-mechanism lever 9 (shown with dashed lines in FIG. 4) to pivot, thus moving the closing wedge 7 (shown with dashed lines in FIG. 5) to the opened position.

As soon as the carrier 11 reaches the highest point 26 of the curved track 15 and the closing wedge 7 is thus automatically stopped in the "opened position" (not shown herein), the new projectile is rammed in with the aid of an automatic loader (not shown herein) and a new propellant charge inserted. The closing wedge 7 is closed with a release lever [trip lever?] (not shown herein), wherein the pin-type carrier 11 follows the steeply descending area of transition 28 between the curved track 15 and the guide track 27, so that the weapon barrel 3 is closed off by the downward dropping closing wedge 7. The next firing can then be triggered.

The invention is not limited to the above-described exemplary embodiment.

It will be apparent, based on this disclosure, to one of ordinary skill in the art that many changes and modifications can be made to the invention without departing from the spirit and scope thereof.

What is claimed is:

1. A wedge-type breechblock for a weapon having a barrel that recoils relative to a cradle, the barrel having a bore with an axis, and a breech plate, the breechblock comprising:

a closing wedge for arranging in the breech plate such that the closing wedge can be displaced transverse to the axis of the bore;

at least one control lever;

a pin-type carrier attached to the control lever;

a breech mechanism shaft that activates the closing wedge, the breech mechanism shaft being connected on a side that faces the cradle to the control lever;

at least one guiding device for guiding the pin-type carrier is provided on the cradle on a side of the cradle that faces the barrel;

an ascending curved track located on the guiding device, along which the pin-type carrier is guided during a counter-recoil motion of the barrel from an intake region to a highest point, so that the control lever is pivoted during the counter-recoil motion of the barrel, and the breech mechanism shaft is turned to move the closing wedge to an opened position; and a straight guide track located on the guiding device, positioned lower than the highest point of the curved track, and which transitions to the intake region of the ascending curved track, wherein at least the curved track of the guiding device that follows the intake region is designed to function as a diverter for the carrier during the counter-recoil motion of the barrel.

2. The wedge-type breechblock according to claim 1, further comprising:

a first part of the guiding device which directly adjoins the intake region and is designed to pivot; and a spring that exerts pressure on the first part of the guiding device around a pivoting axis that is perpendicular to a longitudinal axis of the pin-type carrier, wherein the curved track has at least two adjoining sections, a first section of the curved track being arranged on the first part of the guiding device, and during the recoil motion of the barrel, the pin-type carrier pivots the first part away from the barrel and thus reaches the intake region.

3. The wedge-type breechblock according to claim 2, wherein the length of the first section of the curved track is at least 60% of the total length of the curved track.

4. The wedge-type breechblock according to claim 1, wherein the curved track follows an approximately sine-shaped, ascending course.

5. The wedge-type breechblock according to claim 1, wherein the curved track is a hardened material.

6. The wedge-type breechblock according to claim 2, wherein the guiding device further comprises a second part that defines a second section of the curved track; and a base plate to which the second part is fixedly connected, and to which the first part that supports the first section of the curved track is attached such that it can pivot.

7. The wedge-type breechblock according to claim 6, wherein the base plate as well as the first and second parts of the guiding device are made from cast iron.

8. The wedge-type breechblock according to claim 6, wherein the base plate as well as the first and second parts of the guiding device are made from NiCr18 high quality steel.

9. The wedge-type breechblock according to claim 1, wherein the pin-type carrier is guided inside a groove during the counter-recoil motion of the barrel, and a lower side wall of the groove is formed by the curved track.

* * * * *